US007906717B2

(12) United States Patent
Wang

(10) Patent No.: US 7,906,717 B2
(45) Date of Patent: Mar. 15, 2011

(54) LOCKING DEVICE FOR RETAINING A MUSICAL INSTRUMENT

(75) Inventor: Xianggui Wang, Ningbo (CN)

(73) Assignee: SoundKing Group Co., Ltd., Ningbo (CN)

( * ) Notice: Subject to any disclaimer, the term of this patent is extended or adjusted under 35 U.S.C. 154(b) by 56 days.

(21) Appl. No.: 12/346,581

(22) Filed: Dec. 30, 2008

(65) Prior Publication Data

US 2010/0163693 A1 Jul. 1, 2010

(51) Int. Cl.
*G10D 3/00* (2006.01)

(52) U.S. Cl. ..... 84/327; 248/121

(58) Field of Classification Search ..... 84/421, 84/327, 329, 453; 248/121, 125.2, 125.7, 248/441.1, 443, 452, 113
See application file for complete search history.

(56) References Cited

U.S. PATENT DOCUMENTS

| | | | | |
|---|---|---|---|---|
| 4,205,818 | A | 6/1980 | Lawler | |
| 5,313,866 | A | 5/1994 | Smith | |
| 5,372,346 | A | 12/1994 | Upchurch et al. | |
| 5,664,756 | A | 9/1997 | Liao | |
| 6,005,176 | A | 12/1999 | Yu | |
| 6,036,159 | A | 3/2000 | Yu | |
| 6,127,612 | A | 10/2000 | Yu | |
| 6,439,532 | B1 | 8/2002 | Yu | |
| 6,513,768 | B1 | 2/2003 | Hsieh | |
| 6,772,981 | B1 | 8/2004 | Yu | |
| 6,881,884 | B2 | 4/2005 | Hsieh | |
| 6,982,373 | B1 * | 1/2006 | Yu | 84/327 |
| 7,002,066 | B2 | 2/2006 | Yu | |
| 7,105,732 | B1 | 9/2006 | Hsieh | |
| 7,151,213 | B2 * | 12/2006 | Hsieh | 84/453 |
| 7,259,310 | B2 | 8/2007 | Wilfer | |
| 7,300,027 | B2 | 11/2007 | Walker | |
| 7,351,896 | B2 | 4/2008 | Clifford | |
| 7,423,209 | B2 | 9/2008 | Chen | |
| 7,446,249 | B2 | 11/2008 | Driscoll | |
| 7,547,835 | B1 * | 6/2009 | Mayor | 84/327 |
| 2006/0243686 | A1 | 11/2006 | Grayson | |

OTHER PUBLICATIONS

European Application No. 09180885.7 Extended European Search Report and Opinion dated Jul. 29, 2010, 9 pages.

* cited by examiner

*Primary Examiner* — Gwendolyn Baxter

(57) ABSTRACT

A locking device for retaining a musical instrument can be attached to a stand assembly by a base member. A support unit with an entrance opening supports a portion of the instrument. A force such as gravitational can cause the support unit to rotate a biased locking member to close the entrance opening. Removal of the instrument permits a biasing force to open the locking member.

20 Claims, 7 Drawing Sheets

LOCKING DEVICE FOR RETAINING A MUSICAL INSTRUMENT

BACKGROUND OF THE INVENTION

1. Field of the Invention

The present invention is directed to a locking device for retaining a musical instrument and more particularly to a locking device that can be utilized, for example, with a musical stand or other support structure for operatively suspending a musical instrument during performance and in storage.

2. Description of Related Art

Guitar stands and other supports for musical instruments have been utilized by musicians for a number of years. Typically a guitar stand rests on the floor and supports a guitar from the base and/or the tuning head of the guitar. Alternatively, various structures have been utilized as attachments to walls or to existing stage equipment such as audio speakers, thereby maximizing the available stage space for the performer.

Tripod musical stands frequently use a fork-like structure that can hold musical instruments such as an acoustical guitar suspended in a state of suspension in an offset manner from the stand. Some stands provide an ability to also support the base of the guitar and in most cases, the supporting stand holds musical instruments such as a guitar for relatively ready access during times when the musician does not want to use the instrument or is unable to handle the musical instrument directly.

Such occasions frequently occur during a stage performance, during the playing of the instrument, or when the musician is playing another instrument. Preferably the support stand permits a musician to easily place the instrument onto the stand, as well as to be able to quickly retrieve it from the musical stand. Desirably this should be done with a single hand as the musician's other hand may not be free to handle the musical instrument.

The use of a standard neck fork while facilitating a relatively easy placement and retrieval of the guitar, does not necessarily securely hold it in place while stored on the stand. As can be appreciated, musical instruments can be extremely valuable and can be damaged if they fall from the stand.

Additionally, a performance stage can be a fairly chaotic environment which is further exacerbated by relatively poor or dim lighting conditions between musical performances when the stage lights may be dimmed or turned off. In this environment, a musician frequently changes instruments and would be either placing and/or retrieving a musical instrument from an instrument stand.

The Hsieh (U.S. Pat. No. 6,513,768) discloses a guitar stand with a locking mechanism to retain the neck of a guitar on a musical instrument stand.

Hsieh (U.S. Pat. No. 6,881,884) discloses a guitar stand having arms that can clamp the neck of a guitar that are biased to a closed position. Manually compressing a spring with a handle member can open the arms for receipt of the guitar.

Hsieh (U.S. Pat. No. 7,105,732) discloses a movable bracket for receiving a guitar with rotating locking palms on a stationary collar to secure the guitar.

Wilfer (U.S. Pat. No. 7,259,310) discloses a wall holder for a musical instrument with relatively movable guide bar brackets.

Chen (U.S. Pat. No. 7,423,209) discloses a guitar stand having two arms that are driven along arcuate slots upon receiving the weight of a guitar. The links rotate to secure the guitar neck.

The prior art is still seeking an effecting locking device for retaining a musical instrument on a stand or other support structure and to facilitate an easy release of a musical instrument.

SUMMARY OF THE INVENTION

The present invention permits the storing and retrieving of a musical instrument from a stand that enables a musician to quickly and effectively place the instrument in the instrument stand with one hand and to likewise retrieve the instrument with one hand.

The present invention can be applied to a number of different musical instruments including but not limited to, guitars of electrical and acoustical versions, banjos, violins, violas, cellos and other handheld instrument categories such as brass and woodwinds, that have a portion of the musical instrument that be grasped and held in storage.

The present invention provides relatively simple structures utilizing low cost components with reliability and durability.

In one embodiment of the present invention, gravitational forces can be exerted with counterweights so that a camming surface can rotate when the instrument is inserted and when removed. Locking crank parts can be rotated to an open state when a weight is removed from the camming structure, thereby facilitating the insertion of a portion of a musical instrument to a secure locking position with an easy release from our locking device. The locking device can have a trapezoidal configuration and counterweights can be held in an outer inclined position to avoid potential contact with the instruments. Flexible cushion surfaces can be positioned for further reducing the prospects of marring the surface of the instrument.

A stand assembly, for example, with a lower tripod base and an elevated pole can permit a desired positioning of a locking device that can be removably secured to the elevated pole.

A base member on the locking device is configured to support the musical instrument while a support unit is connected to the base member with an entrance opening for a musical instrument. The support unit is positioned to contact and rotate in contact with a musical instrument as the musical instrument is both operatively positioned within the support member for storage and is removed for retrieval.

A locking member, or preferably a pair of locking members, can be movably mounted on the support unit and are configured to open and close an entrance opening through which a portion of the musical instrument can move, whereby the support unit rotates the locking member from an open to a closed position in a first direction of movement. A second direction of movement of the musical instrument provides an open position for the locking members.

In a second embodiment of the present invention, a locking device can also be removably attached to a musical stand and includes a base member configured to support the musical instrument.

A support unit having a receptacle portion, for receiving a portion of a musical instrument, is rotatably connected to the base member so that when a musical instrument is operatively positioned for storage within the receptacle position, the musical instrument's weight can rotate the support unit.

A locking member or a pair of locking members can be movably mounted on an entrance of the receptacle portion and are configured to open and close the entrance opening. A first rotation of the support unit will move the locking members into a locking position to retain the musical instrument while a second pivotal rotation, in a direction opposite to the first pivotal rotation of the support member, will enable the locking members to be moved to a release position for removal of the musical instrument.

The support unit can have a planar viewed Y-shape with a locking member biased to an open position at either side of the entrance of the receptacle portion. A cable is operatively connected at one end to each of the locking members to close the locking members when the support unit is rotated to a closed position by the weight of the musical instrument. Pulleys can guide each cable in the receptacle portion with the other end of the cables being adjustably mounted in the base member, whereby rotational movement of the support unit provides a force to the locking members through the respective cables to overcome the bias to provide the closed position.

A pedestal support can be provided on a musical stand elevated pole, to limit the movement of the support member in a horizontal closed position. When a musical instrument is removed, the support member is raised to an inclined open position.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures and components have not been described in detail as not to unnecessarily obscure aspects of the present invention.

The locking device alone or in combination with the support stand of the present invention has been illustrated for a musical instrument such as a guitar. However, other musical instruments having a neck or similar taper, in particular a stringed instrument such as bass guitars, ukuleles, banjos, violins, violas, cellos, as well as other handheld instruments such as brass and woodwinds which can be hung, fastened or stored in a similar manner as a guitar, can utilize the advantages of the present invention.

Referring to FIG. 1, and FIGS. 2A, 2B and 2C, a musical instrument such as a guitar, is disclosed positioned on musical support stand 4 having an elevated and adjustable pole 6. As can be appreciated, these instruments can have a tripod base as shown. A locking device 2 of the first embodiment is shown for locking the neck portion of the musical instrument so that it is suspended in a stored storage mode. A cantilevered arm 7 (see FIG. 5) extending horizontally outward from the pole 6 can distance the body of the guitar away from the pole 6.

Figure 1:
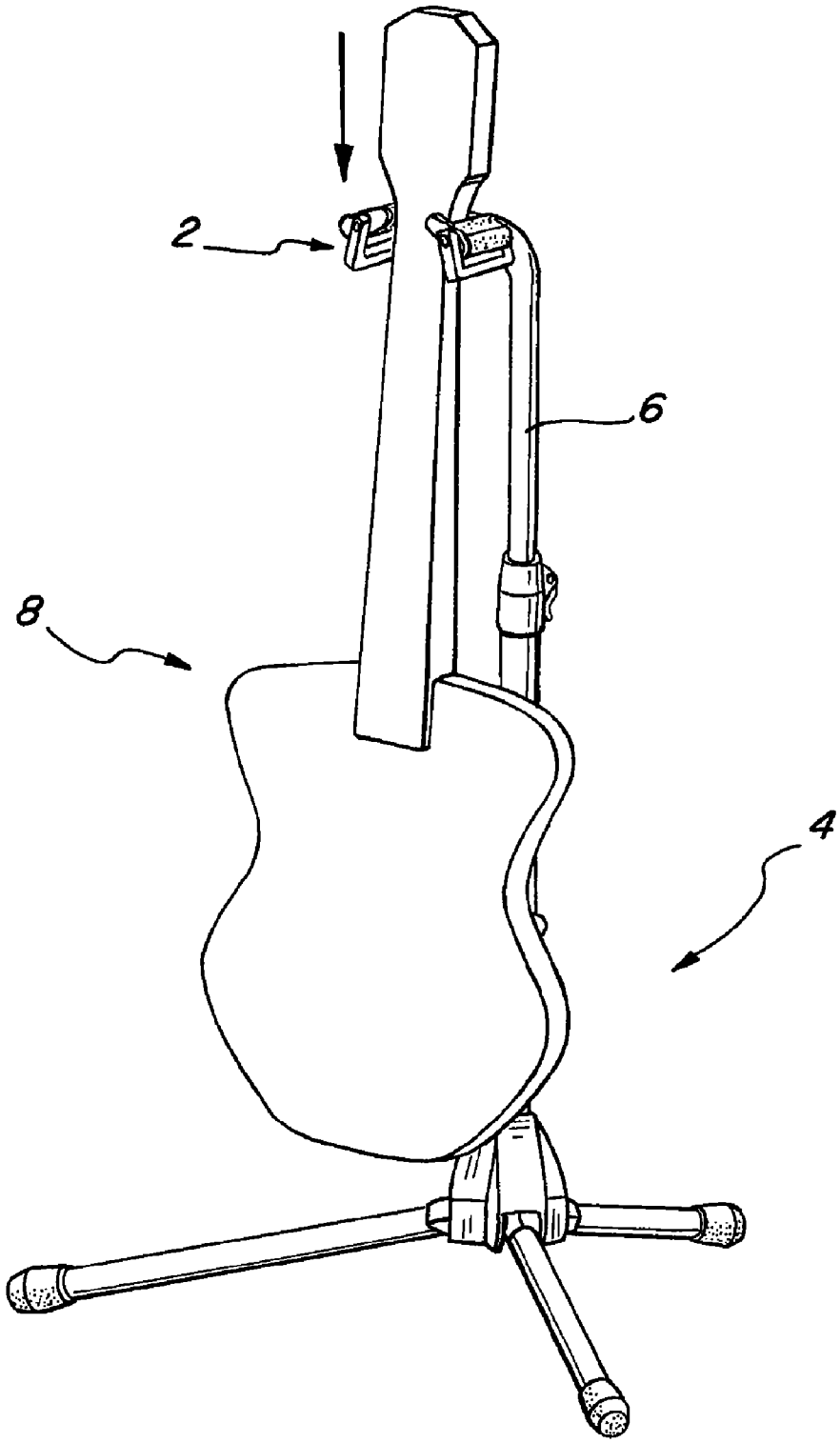
FIG. 1 is a perspective view of a first embodiment of the present invention.
Figure 2C:
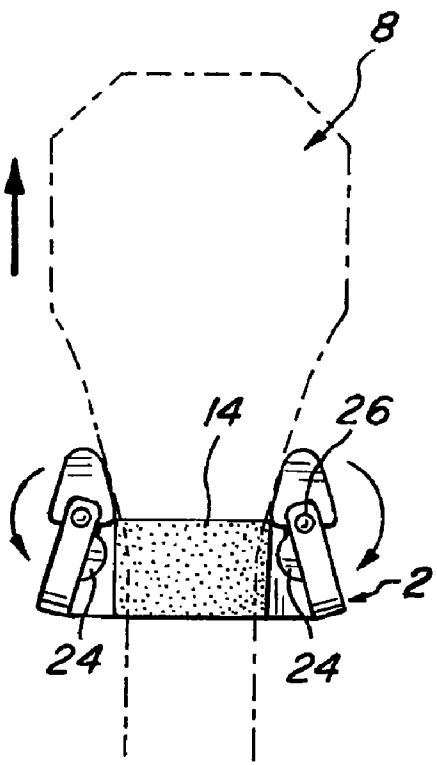
FIG. 2C discloses a musical instrument being removed and releasing the counterweights to open the locking members.
Figure 2B:
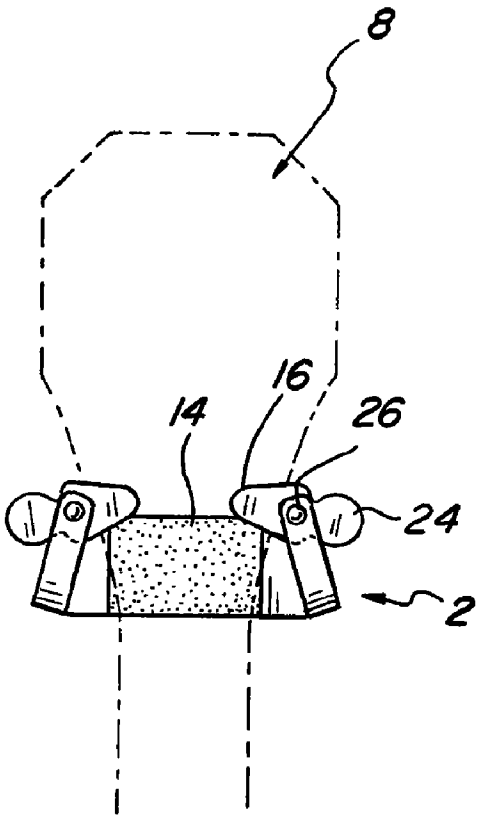
FIG. 2B discloses the locking device in a storage mode.
Figure 2A:
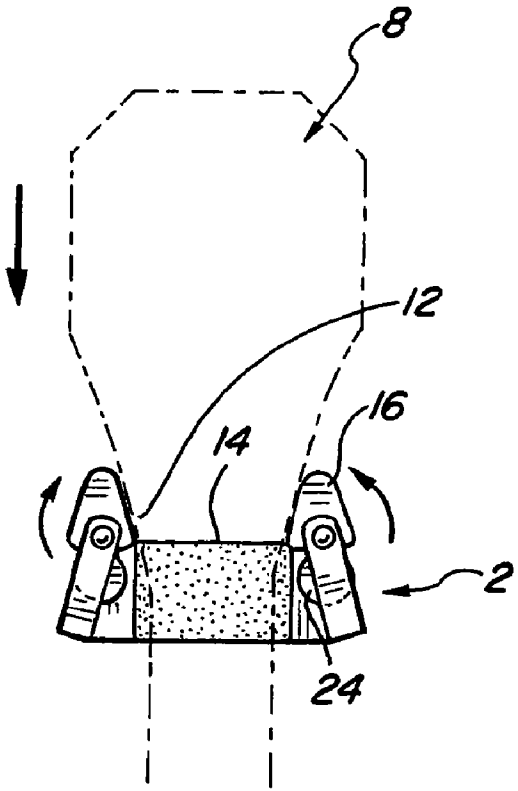
FIG. 2A is a schematic drawing showing a guitar neck being placed in the locking device of the first embodiment.

Referring to FIG. 2A, the neck portion of the musical instrument is being inserted into the locking device 2 and contacts pivotable support units 12 having locking members 16 in an open position. While not shown, the musician's hand has placed the musical instrument 8 within the locking device 2 and releases the support of the musical instrument so that the support units 12 are contacted and bear the weight of the musical instrument and rotates with that portion of the musical instrument 8 in contact. Alternatively, the musician can pull the instrument 8 downward to contact and activate the locking device rather than rely on a gravitational pull on the instrument 8. Counterweights 24 which extend off of a central support rod or shaft 26 are rotated outward approximately 90° as shown in FIG. 2B and the integral locking members 16 or crank portions close the entrance opening 14 in a locked mode of storage.

When the musician again grasps the musical instrument 8 and lifts it upward, its weight is released from the locking device 2 and the support members 18 on the support units 12 and the counterweights 24 can then rotate under the force of gravity to the lower position to in turn rotate the locking member 16 upward and away from blocking the entrance opening 14 to thereby permit a release of the musical instrument 8.

Figure 3:
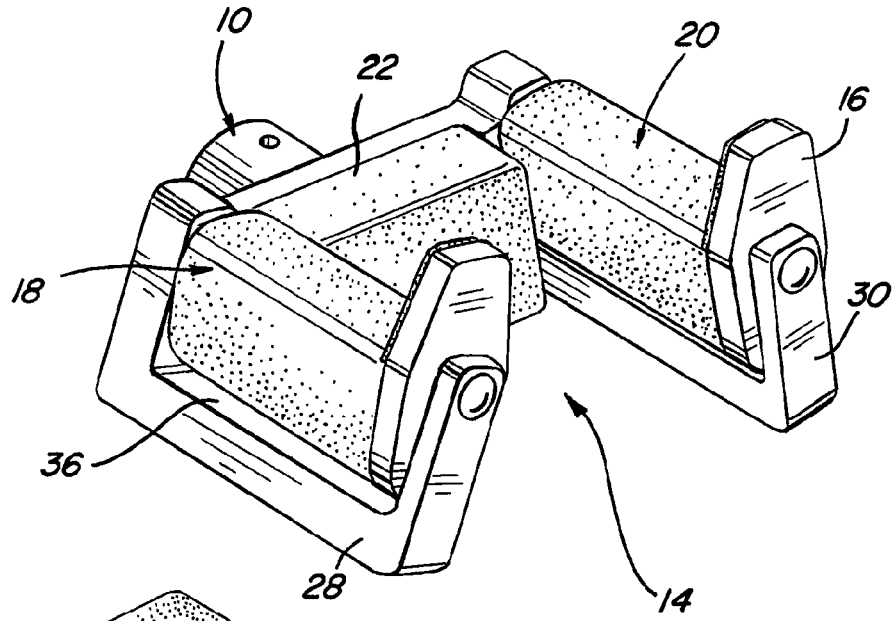
FIG. 3 is a perspective view of the locking device of the first embodiment.

Referring to FIG. 3, the base member 10 is configured for mounting on the elevated pole 6 of the support stand 4. The support unit includes a pair of U-shaped arms 28 and 30, as seen from a side view. The U-shaped arms are inclined outward in a trapezoidal configuration from the front or entrance view 14. The U-shaped arms 28 and 30 extend substantially parallel to respectively define the entrance opening 14 and then an extended rivet member or rod 26 can be fastened through the bore openings 32 and 34 to rotatably mount the support members 18, the integral locking member 16, and the counterweight 24. The support members 18 can have a resilient surface portion 20 or covering operatively configured to contact the enlarged head of the musical instrument and extending over the counter weight 24 and the interior surface of the lock members. The resilient surface portion 20 not only prevents any marring or scratching of the neck, for example of the guitar, but is further positioned to rotate with a downward and upward movement of the guitar during a respective storage and release mode of operation. The counterweights 24 can be limited in movement by the roller surface or seat 36 of the respective U-shaped arms. As a result, the counterweights cannot extend within the cavity between the respective U-shaped arms 28 and 30 and will not contact nor mar the musical instruments. Additionally, a defined open position is assured for the respective locking members 16.

A rear resilient pad 22 of a trapezoidal shape can be mounted on the base member 12 to further protect the musical instrument 8. Preferably, the rear resilient pad can be molded and adhered to a channel on the face of the base member at the rear surface between the U-shaped arms 28 and 30, as shown in FIG. 4 and can also limit, at the side edges, the rotational movement of the support members 18 by extending into the space between the support units 18.

Figure 4:
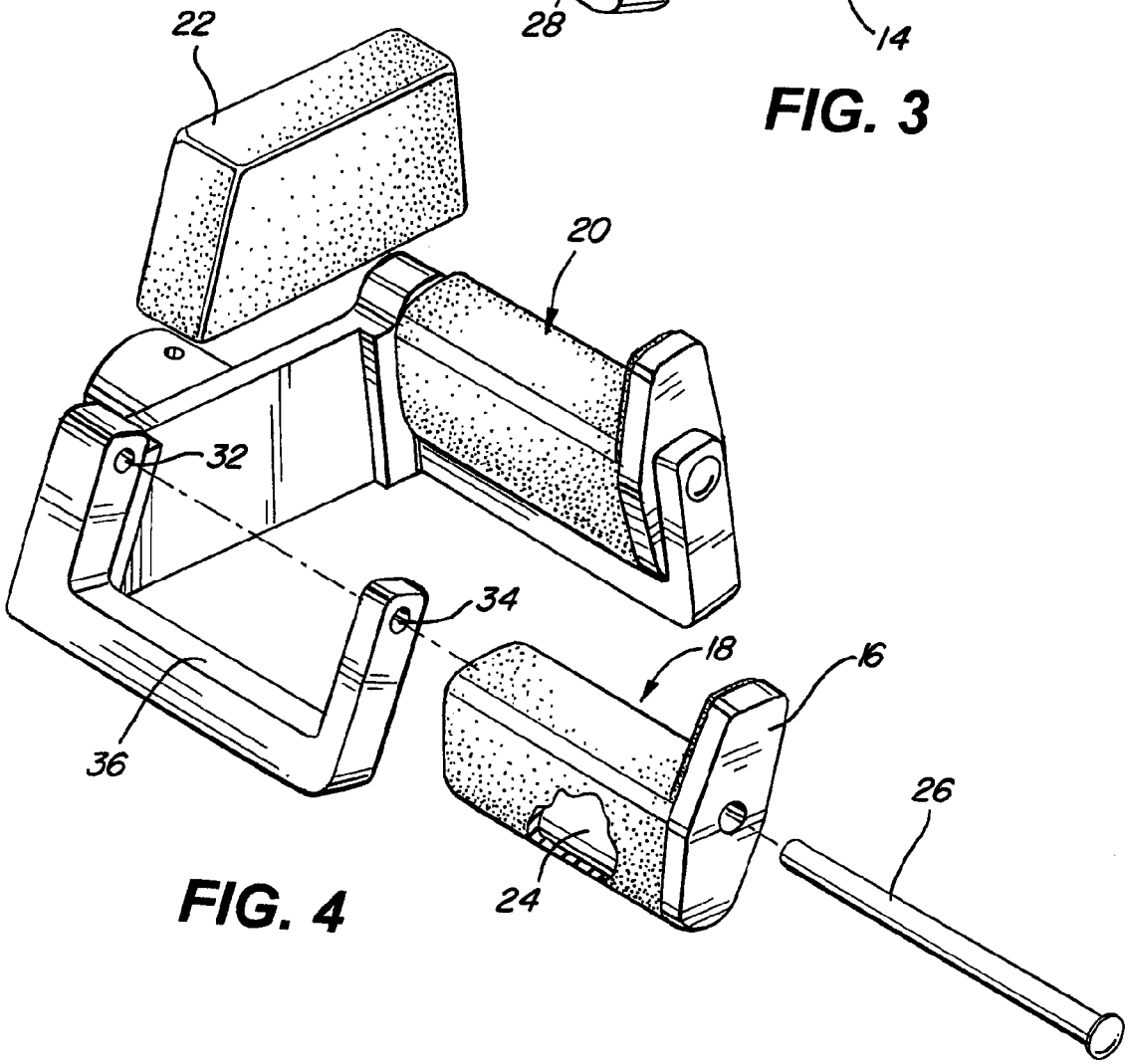
FIG. 4 is an exploded view of the locking device of the present invention.

As can be seen in the respective embodiments of FIGS. 3 and 4, a relatively simple but effective locking device 2 is provided in the first embodiment with components that can be cast or machined to provide a relatively inexpensive and durable locking device. Alternatively it can be made from molded plastic resin compounds. Additionally, the assembly is relatively easy and the locking device can be readily mounted in various forms of musical stands.

Figure 5:
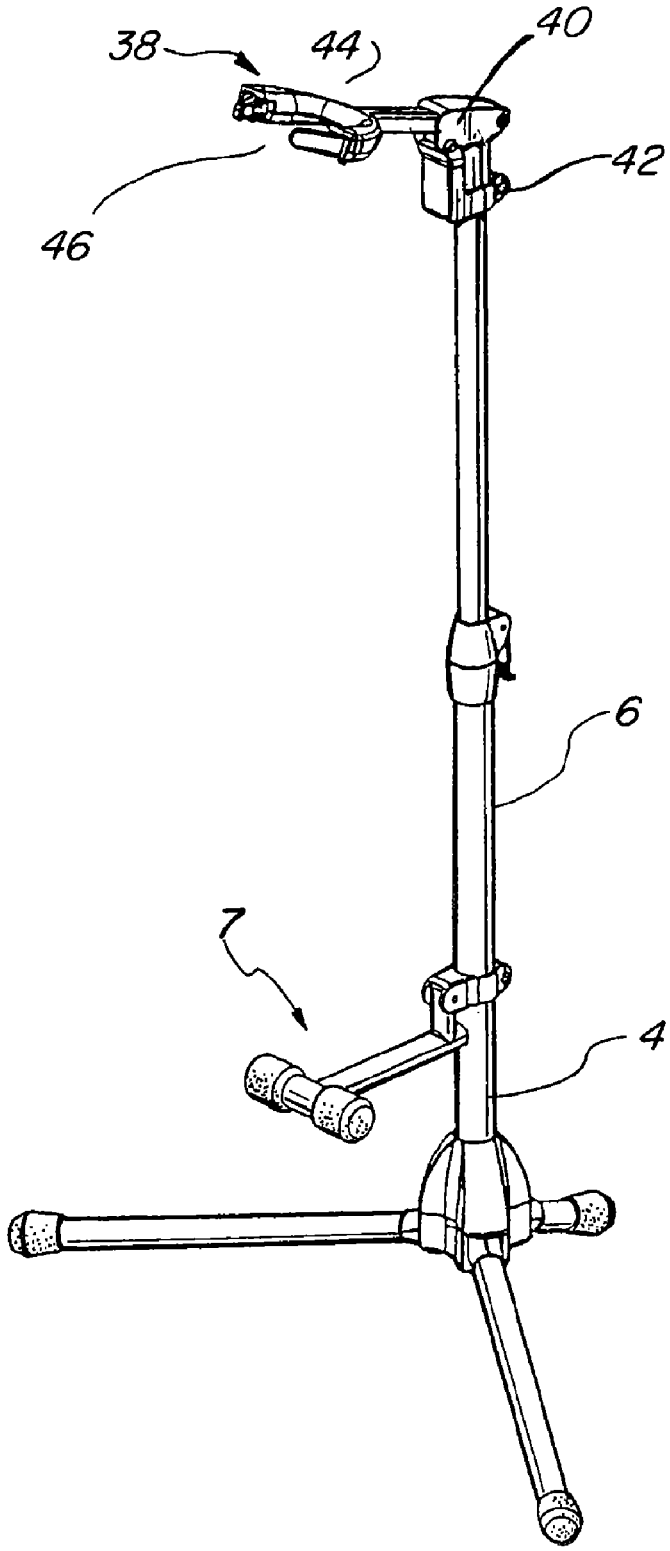
FIG. 5 is a perspective view of a second embodiment of the present invention.

A second embodiment of the present invention is disclosed in the perspective view of FIG. 5 of a locking device 38 mounted at the top of a pole 6 on the musical support stand 4.

A base unit 40 is attached to the top of the pole 6 with a lower pedestal support portion 42. In the embodiment shown in FIG. 5, a support unit 44 of the locking device 38 has a receptacle portion 46 of a plastic Y shape that can receive the musical instrument when the arms 48 and 50 have their respecting locking members 52 and 54 in an open position.

Figure 6:
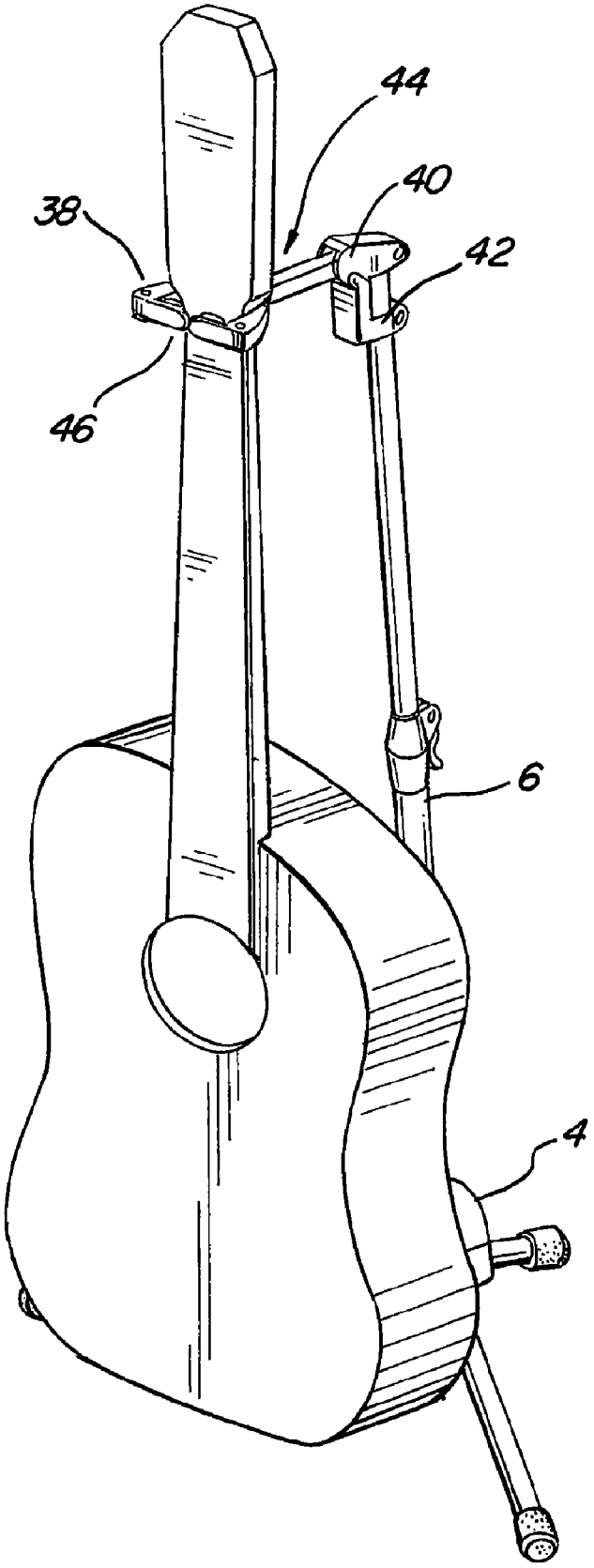
FIG. 6 is a schematic view of the second embodiment storing a musical instrument.

The perspective view of FIG. 6 shows the musical instrument 8, such as a guitar, with its neck portion located within the receptacle portion 46 and the respective locking members 52 and 54 in a closed or locking clamped position for storage purposes. As can be appreciated, the supporting unit 44 has been lowered to a horizontal position as further limited by contact with the lower pedestal support 42. The body of the musical instrument 8 is positioned away from the pole 6 by the cantilevered arm 7 with appropriate resilient pads as shown in FIG. 5.

Figure 9:
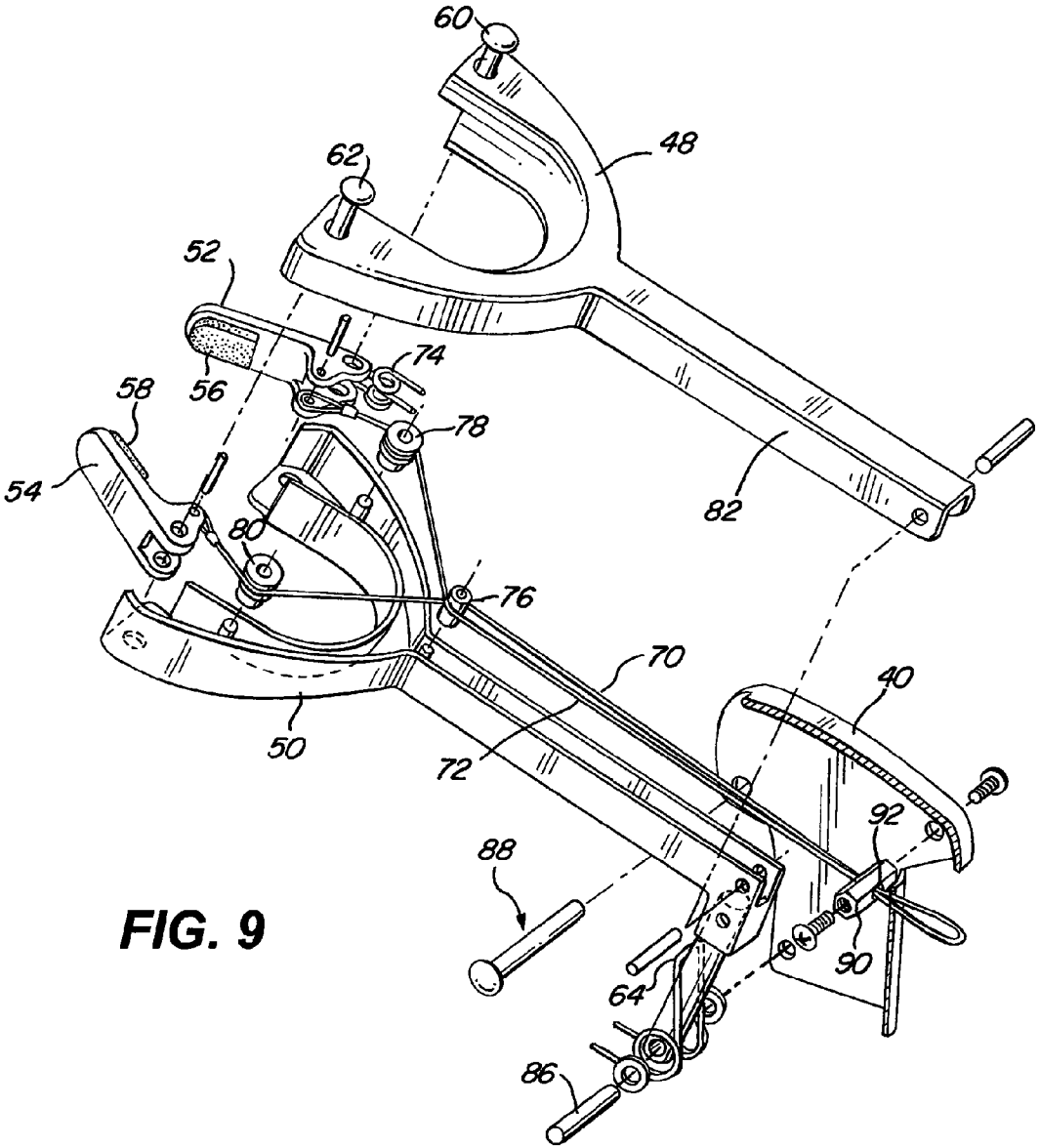
FIG. 9 is a partial exploded view of the locking device of the second embodiment.

In comparison with the position of the support unit 44 in FIG. 5, the support unit 44 is biased to an open position by a tension arm spring 64 so that it is inclined slightly in an upward direction relative to the connection to the pole 6 as shown in FIG. 9.

Figure 7:
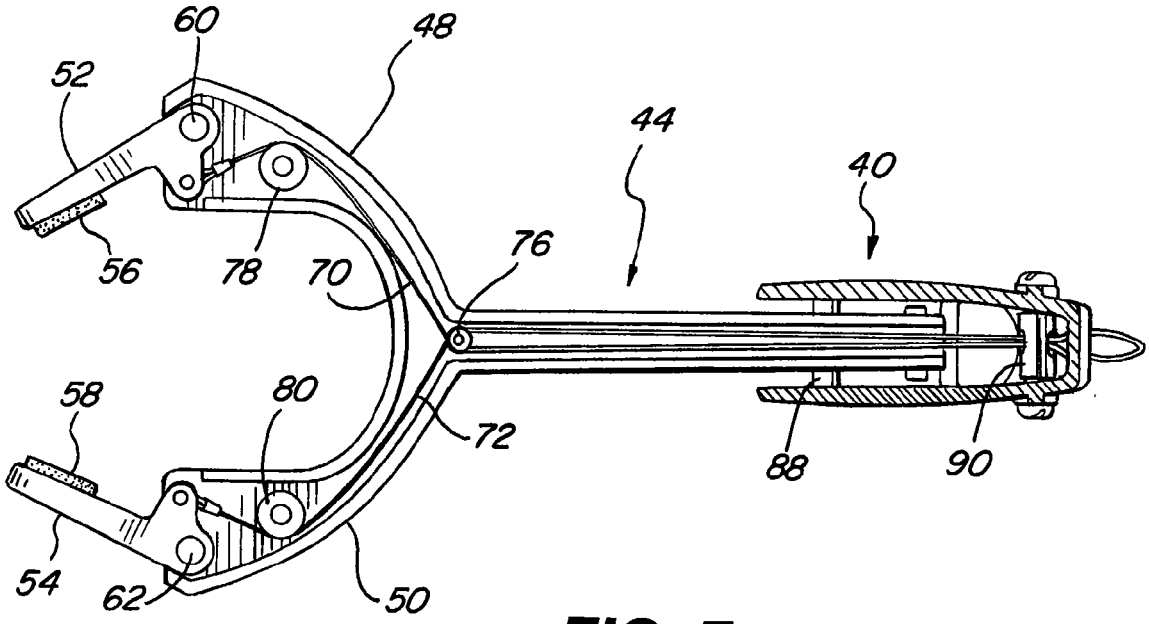
FIG. 7 is a cross-sectional view of the locking device of the second embodiment in an open position.
Figure 8:
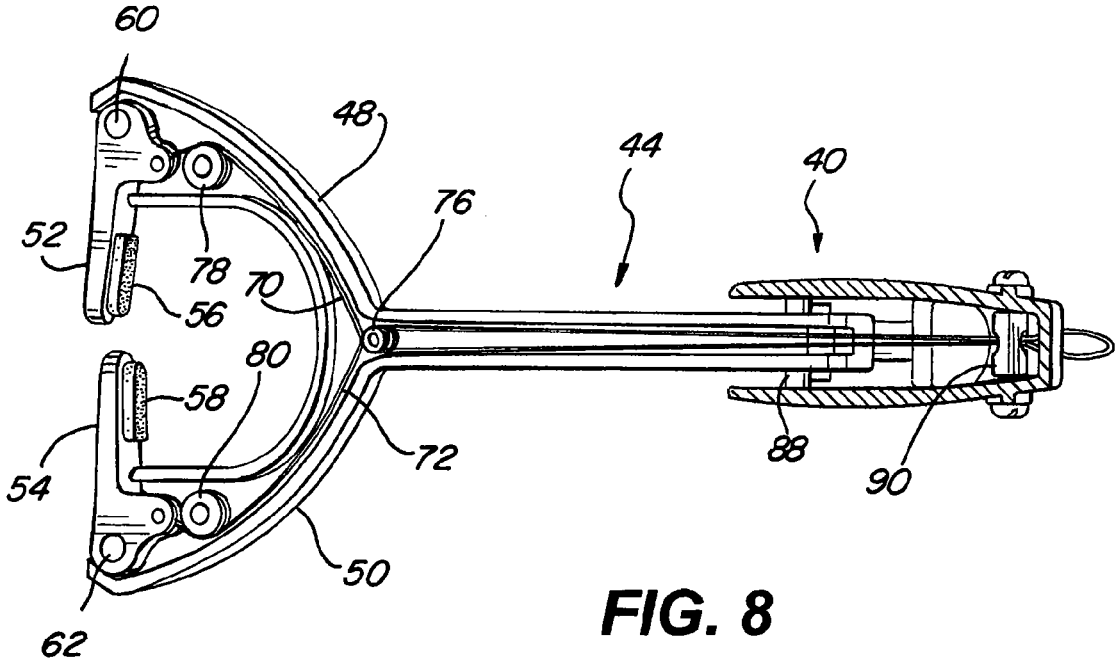
FIG. 8 is a cross-sectional view of a locking device of the second embodiment in a closed position.

Referring also to FIGS. 7 and 8, a cross-sectional view of the support unit 44 with the receptacle portion 46 in an open position, is disclosed. Note, the upper covering 82 (FIG. 9) is removed in these views. Locking members 52 and 54 are extended to an open position and their inward surfaces are provided with flexible cushion pads 56 and 58, respectively. The respective locking members 52 and 54 have an L-shape configuration with an open bore at a corner of the L-shape capable of mounting rivets 60 and 62, respectively, to provide a pivot position on the arms 48 and 50. The bottom legs of the L-shaped locking members 52 and 54 have open bores for mounting pins 66 and 68 to respectively capture connections at the ends of cables 70 and 72.

The L-shaped locking members 52 and 54, respectively, have torsion springs 74, one of which is shown in FIG. 9, that are captured by the respective pivots 60 and 62 which bias the respective locking members 52 and 54 to an open position, as shown in FIG. 7. As can be seen in FIG. 7, respective flexible cables 70 and 72 are guided at the base of the Y by a central pulley 76 by respective pulleys 78 and 80 located in the arms 48 and 50 of the receptacle portion 46.

When the support unit 44 is lowered by the weight of the musical instrument from the open position shown in FIG. 7, the particular offset mounting of the respective cables 70 and 72 holds the respective locking members 52 and 54 to the closed position in FIG. 8. The pivotal movement of the support unit is displaced from the anchor position of the cables 70 and 72 to pull the cables relatively backward.

Referring to FIG. 9, the support unit 44 has an upper Y-shaped covering 82 and a lower Y-shaped covering 84. When the covers are connected together by attachment of the rivets 60 and 62 that also serve to function as pivoting shafts and the mounting of the pivot rivet 86 through the lower covering 84 and the base unit 40, permits the relative movement of the support unit 44. The tension arm spring 64 is also held in place by the pivot rivet 86 and biases the support unit 44 to an open position inclined upward from the horizontal support position.

A stop member 88 extends in the base member across the lower surface of the lower covering 84 and when contacted holds the support unit 44 in a horizontal closed position.

The ends of the cable 70 and 72 are adjustably mounted onto a fixed block member 90 having a traverse hole for securing the ends of the cable 70 and 72. A set screw 94 is utilized to lock the cable block 90 in the desired position at an anchor pivot position offset radially from the pivot rivet 86.

Since the pivot rivet 86 is offset and displaced from the anchor point of the cables 70 and 72 on the cable block 90, the rotation of the support unit 44 against the bias of the tension arm spring 64, when a musical instrument's weight is deposited in receptacle portion 46, permits the ends of the cables 70 and 72 to be guided by the respective pivots 76 and 78, to close the respective locking members 52 and 54 against the respective torsion spring 74 to a locking position. Conversely, when the weight of the musical instrument 8 is removed from the receptacle portion 46 as the musician lifts, for example, the guitar upward, the support unit 44 is moved upward by the tension arm spring 64 and the cable pull is released so that the respective torsion springs 74 can force open the locking members 52 and 54 whereby the guitar is released from the locking device.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A locking device for retaining a musical instrument comprising:

a base member configured to support a musical instrument;

a support unit connected to the base member and having an entrance opening for the musical instrument and positioned to contact and rotate with the musical instrument as the musical instrument is operatively positioned within the support member for storage;

a locking member movably mounted on the support unit and configured to open and close the entrance opening through which a portion of the musical instrument can move, whereby the support unit rotates the locking member from an open to a closed position in a first direction of movement and in a second direction of movement provides the open position; and a counterweight member of sufficient weight and extending from the support unit to rotate the locking member from the closed position to the open position when the musical instrument is removed from contact with the support unit.

2. The locking device of claim 1 wherein the support unit has a resilient surface portion on a support member for contacting the musical instrument and is mounted for rotation about a shaft member, the counterweight member extends approximately 90° from the shaft member, relative to the support unit.

3. The locking device of claim 2 wherein the support unit includes a pair of U-shaped arms extending substantially parallel to respectively define the entrance opening.

4. The locking device of claim 3 wherein the support member, a locking member and a counterweight member are operatively mounted on each U-shaped arm.

5. The locking device of claim 1 wherein the base member is configured for mounting on a support stand and forms with the support unit a plane view U-shape with a pair of U-shaped arms viewed traverse to the plane view.

6. The locking device of claim 5 wherein the pair of U-shaped arms are inclined at an angle towards each other and pivotally mount an integral support member, locking member and counterweight member.

7. The locking device of claim 6 wherein each support member has a resilient surface of a curved configuration for physically contacting and rotating with movement of the musical instrument and the locking member is cantilevered from the support member adjacent the entrance opening.

8. The locking device of claim 6 wherein a shaft mounts the support member for relative movement with each U-shaped arm and the counterweight member rests on the seat portion of the U-shaped arm in an open position.

9. The locking device of claim 8 wherein the counterweight member extends below the support member and is configured to extend to one side of the U-shaped arm when a musical instrument rotates the support member to rotate the locking member into the closed position across the entrance opening.

10. The locking device of claim 1 further including a stand assembly having an elevated pole, the base member is configured for attachment to the elevated pole.

11. A locking device for restraining a musical instrument comprising:

a base member configured to support a musical instrument;

a support unit having a receptacle portion for receiving a portion of the musical instrument, the support unit is connected to the base member and rotatable relative to the base member when the musical instrument is operatively positioned for storage in the receptacle portion and the musical instrument's weight rotates the support unit;

a locking member is movably mounted on the receptacle portion and configured to open and close an entrance opening of the receptacle portion wherein a first pivotal rotation of the support unit will move the locking member into a locking position to retain the musical instrument and a second pivotal rotation in a direction opposite to the first pivotal rotation will move the locking member to a release position to enable removal of the musical instrument; and a cable is operatively connected at one end to the locking member to close the locking member while the support unit has a planar viewed Y-shape with the locking member biased to an open position on the receptacle portion.

12. The locking device of claim 11 wherein a pair of locking members are each connected with a cable and a pulley guides each cable in the receptacle portion and the other end of each cable is adjustably mounted in the base member whereby rotational movement of the support unit provides a force to each locking member to overcome the bias to provide the closed position.

13. The locking device of claim 12 further including a rotatable block member mounted in the base member for connection to the other end of the cable.

14. The locking device of claim 11 further including a stand assembly and a pedestal support which is operatively mounted on the stand assembly to limit the support member to a horizontal closed position.

15. The locking device of claim 11 further including a spring member in the base member to bias the support member to an upwardly inclined open position from the base member.

16. A locking device for retaining a musical instrument comprising:

a base member configured for mounting on a support stand to support a musical instrument;

a support unit with a pair of U-shaped arms connected to the base member and having an entrance opening between the U-shaped arms for the musical instrument and a support member is positioned on each U-shaped arm to contact and rotate with the musical instrument as the musical instrument is operatively positioned within the support unit for storage;

a locking unit movably mounted on the support unit and configured to open and close the entrance opening through which a portion of the musical instrument can move; and a counterweight unit movably mounted on the support unit, whereby the support unit rotates the locking unit from an open to a closed position in a first direction of movement when the musical instrument contacts the support member to rotate the support members and the counterweight unit until the musical instrument is stored in a stationary position within the locking device and the support unit rotates the locking unit from the closed position in a second direction of movement when the musical instrument is lifted from the stationary position and the counterweight unit moves the locking unit to an open position.

17. The locking device of claim 16 wherein the locking unit includes a locking member pivotally mounted with each support member and the counterweight unit includes a counterweight member pivotally mounted with each support member.

18. The locking device of claim 17 wherein each support member has a resilient surface of a configuration for physically contacting and rotating with movement of the musical instrument and each locking member is cantilevered from the support member adjacent the entrance opening.

19. The locking device of claim 16 wherein a shaft mounts the support member for relative movement with each U-shaped arm and the counterweight member is retained on a seat portion of the U-shaped arm in an open position.

20. The locking device of claim 19 wherein the counterweight member extends below the support member and is configured to extend to one side of the U-shaped arm when the musical instrument rotates the support member to rotate the locking member into the closed position across the entrance opening.

* * * * *